US009446274B1

(12) United States Patent
Chen

(10) Patent No.: US 9,446,274 B1
(45) Date of Patent: Sep. 20, 2016

(54) TRAMPOLINE COURT WITH PULLDOWN SPRINGS

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 14/690,627

(22) Filed: Apr. 20, 2015

(51) Int. Cl.
*A63B 5/11* (2006.01)

(52) U.S. Cl.
CPC ..... *A63B 5/11* (2013.01)

(58) Field of Classification Search
CPC .. A63B 5/11; A63B 71/022; A63B 2210/50; A63B 21/023; A63B 2208/12; A63B 2209/10; A63B 2071/0063; A63B 2225/62; A63B 2220/833; A63B 71/0054; A63B 2071/009; A63B 21/026; A63B 21/0552; A63B 2225/093; A63B 2244/08; A63B 2244/12; A63B 5/00
USPC ..... 482/23, 27–29
See application file for complete search history.

(56) References Cited

U.S. PATENT DOCUMENTS 2,534,019 A * 12/1950 Griswold ..... A47C 17/68 482/28
2,991,841 A * 7/1961 Sampson ..... A63B 5/11 482/27
3,201,126 A * 8/1965 Nissen ..... A63B 5/11 182/139
3,339,925 A * 9/1967 Nissen ..... A63B 5/11 182/137
3,501,141 A * 3/1970 Nissen ..... A63B 5/11 482/29
4,331,329 A * 5/1982 Mirkovich ..... A63B 5/11 482/27
4,341,379 A * 7/1982 Milligan ..... A63B 5/11 482/28
5,545,110 A * 8/1996 Hsiang ..... A63B 5/11 482/27
5,941,798 A * 8/1999 Coan ..... A63B 5/11 482/27
5,967,943 A * 10/1999 Rich ..... A63B 5/11 182/37
5,984,837 A * 11/1999 Weaver ..... A63B 5/11 135/116
6,001,045 A * 12/1999 Gift ..... A63B 5/11 482/27
6,036,620 A * 3/2000 Yang ..... A63B 5/11 482/27
6,129,649 A * 10/2000 Yang ..... A63B 5/11 482/27
6,193,632 B1 * 2/2001 Steger ..... A63B 5/11 482/27
6,733,420 B1 * 5/2004 Schroeder ..... A63B 5/11 482/27
2002/0098948 A1 * 7/2002 Yoon ..... A63B 5/11 482/27
2003/0036460 A1 * 2/2003 Publicover ..... A63B 5/11 482/27

(Continued)

*Primary Examiner* — Loan H Thanh
*Assistant Examiner* — Andrew S Lo
(74) *Attorney, Agent, or Firm* — Clement Cheng

(57) ABSTRACT

A trampoline has an upper frame having a first upper frame member and a second upper frame member. The trampoline bed is held in tension between and extended between the first upper frame member and the second upper frame member. The first upper frame member is a different height than the second upper frame member. Trampoline bed springs connect between the upper frame and the trampoline bed. A pulldown spring is mounted between the trampoline bed and a lower frame. The pulldown spring is held in tension at a trampoline bed reinforcement panel. The pulldown spring biases the trampoline bed reinforcement panel toward the lower frame. A folding angle is formed on the trampoline bed.

17 Claims, 3 Drawing Sheets

(56) References Cited

U.S. PATENT DOCUMENTS

2003/0037812 A1* 2/2003 Stewart ..... A47K 3/286 135/96
2003/0104905 A1* 6/2003 Publicover ..... A63B 5/11 482/27
2005/0113213 A1* 5/2005 Alexander ..... A63B 5/11 482/27
2006/0172861 A1* 8/2006 Wang ..... A63B 5/11 482/27
2007/0010374 A1* 1/2007 Widich ..... A63B 5/11 482/27
2007/0072738 A1* 3/2007 Lai ..... A63B 5/11 482/28
2007/0142180 A1* 6/2007 Publicover ..... A63B 5/11 482/27
2012/0142500 A1* 6/2012 Ronan ..... A63B 5/11 482/29
2013/0310223 A1* 11/2013 Canales ..... A63B 5/11 482/27
2014/0005003 A1* 1/2014 Howell ..... A63B 5/11 482/27
2014/0051550 A1* 2/2014 Chen ..... A63B 5/11 482/27
2014/0135178 A1* 5/2014 Smock ..... A63B 5/11 482/27
2014/0228176 A1* 8/2014 Miller ..... A63B 5/11 482/27
2015/0157889 A1* 6/2015 Miller ..... A63B 5/11 482/27

* cited by examiner

TRAMPOLINE COURT WITH PULLDOWN SPRINGS

FIELD OF THE INVENTION

The present invention is in the field of trampolines.

DISCUSSION OF RELATED ART

Trampoline courts have become popular in backyards and specialized trampoline court facilities. Trampolines generally have a trampoline bed and a frame extending around the trampoline bed. The trampoline bed is connected to the frame by trampoline bed springs. A variety of different configurations can be made for trampolines including oval, square and rectangular shaped trampolines.

Some trampolines have a contoured profile having angled trampoline beds that are angled from each other. For example, in United States patent publication US20130310223 to Canales published Nov. 21, 2013, the disclosure of which is incorporated herein by reference, a plurality of sash chains 2004, and springs 2003 provide a tension for maintaining a profile of the trampoline surface. Unfortunately, the Canales device is suited for large trampoline parks.

SUMMARY OF THE INVENTION

A trampoline has an upper frame having a first upper frame member and a second upper frame member. The trampoline bed is held in tension between and extended between the first upper frame member and the second upper frame member. The first upper frame member is a different height than the second upper frame member. Trampoline bed springs connect between the upper frame and the trampoline bed. A pulldown spring is mounted between the trampoline bed and a lower frame. The pulldown spring is held in tension at a trampoline bed reinforcement panel. The pulldown spring biases the trampoline bed reinforcement panel toward the lower frame. A folding angle is formed on the trampoline bed.

The folding angle separates the trampoline bed between a first trampoline bed area and a second trampoline bed area, wherein the folding angle is obtuse and is measured as the angle between the first trampoline bed area and the second trampoline bed area. The trampoline optionally has a pulldown spring connector connecting the pulldown spring to the pulldown flap. The pulldown spring connector is formed as a loop having a narrow end and a wide end. The narrow end is connected to the pulldown spring and the wide end is connected to the pulldown flap. The pulldown flap can have a pulldown connector flap forming a loop around the wide end of the pulldown spring connector. The pulldown connector flap extends from a main portion of the pulldown flap. A pulldown connector flap stitching edge stitches the pulldown connector flap to the main portion of the pulldown flap.

The lower frame hook is formed on a lower portion of the pulldown spring. The pulldown spring is configured as a coil spring. The lower frame hook engages a lower frame hook opening formed on the lower frame, and the lower frame is a tubular steel member. The trampoline bed reinforcement panel is formed as a strip of fabric that connects to the first trampoline bed area and the second trampoline bed area. The trampoline bed reinforcement panel is connected to the pulldown flap. The pulldown flap is rectangular and has pulldown connector flaps extending from a lower edge of the pulldown flap. The first trampoline bed area is an inclined trampoline bed area, and the second trampoline bed area is a generally horizontal trampoline bed area. The pulldown springs are substantially vertically oriented and arranged in an array along a plane such that they form a spring panel. The vertically oriented springs have spring gaps between them.

An object of the invention is to create a trampoline park like angled trampoline bed construction on a small backyard scale by improving dynamic response with using force distribution means such as a trampoline bed reinforcement panel.

Figure 1:
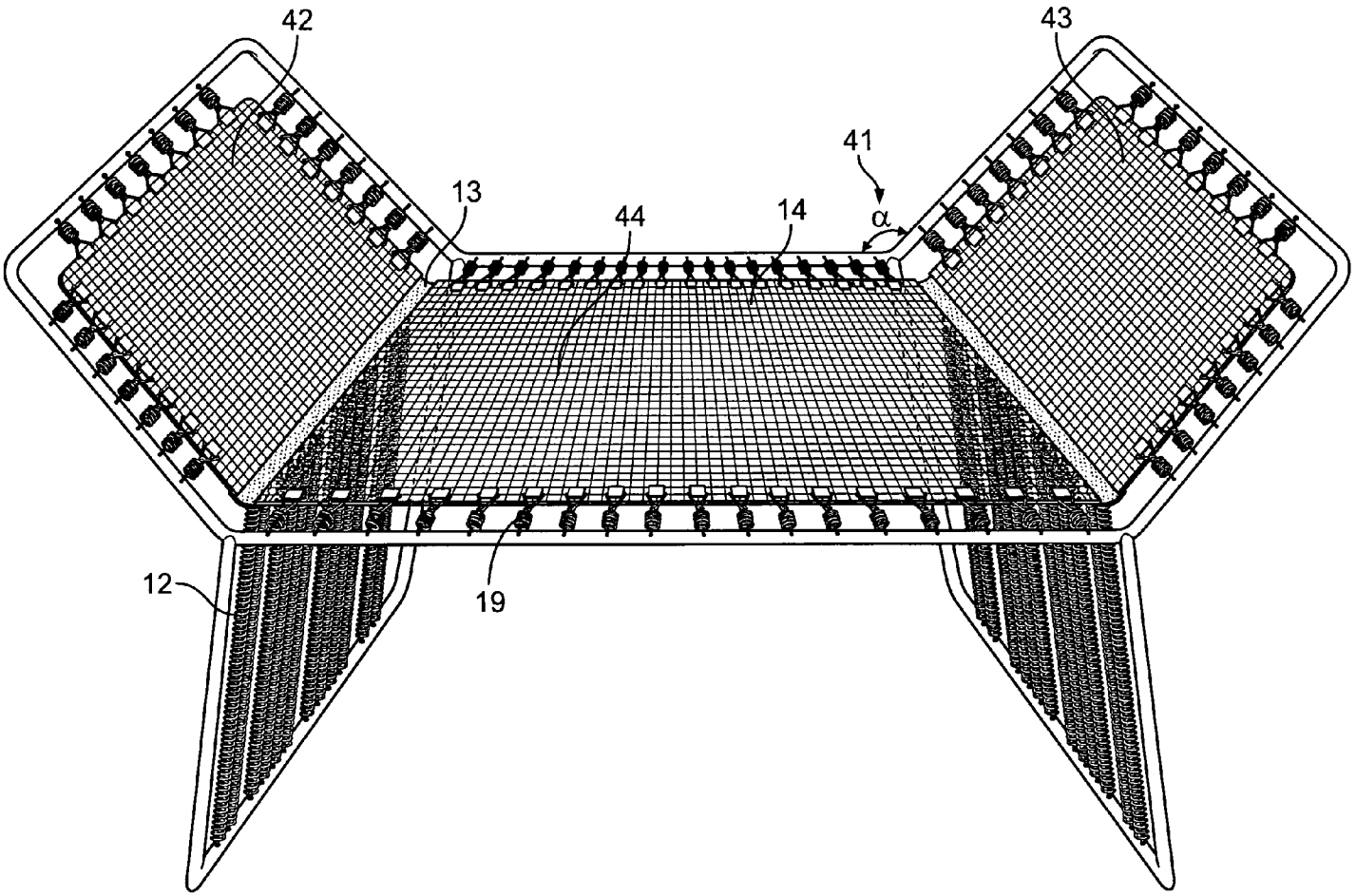
FIG. 1 is a perspective view of the present invention.
Figure 2:
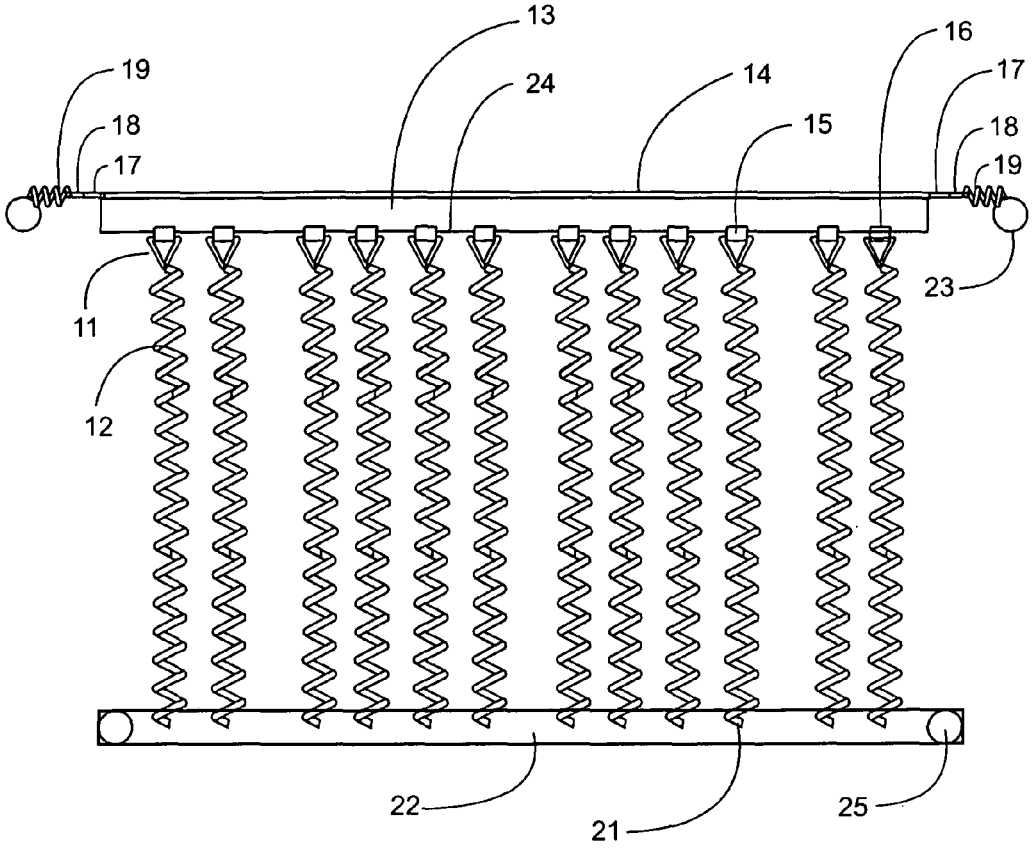
FIG. 2 is a front view of the present invention.

The following call out list of elements can be a useful guide for referencing the elements of the drawings.

10 Spring Panel
11 Pulldown Spring Connector
12 Pulldown Springs
13 Pulldown Flap
14 Trampoline Bed
15 Pulldown Connector Flap
16 Pulldown Connector Flap Stitching Edge
17 Bed Connector Flap
18 Trampoline Bed Spring Connector
19 Trampoline Bed Spring
21 Lower Frame Hook
22 Lower Frame
23 Upper Frame
25 Lower Frame Cross Support
26 Lower Frame Hook Opening
27 Trampoline Bed Reinforcement Panel
41 Fold Angle
42 Left Trampoline Bed
43 Right Trampoline Bed
44 Middle Trampoline Bed
45 Spring Gap
46 Spring Coil Winding
47 Upper Frame Opening Hook
51 Crosswire
52 Crosswire Panel

DETAILED DESCRIPTION OF THE PREFERRED EMBODIMENT

A trampoline has a frame, springs connected to the frame and a bed that is held in tension across the frame at an upper portion of the bed. The trampoline frame is made of tubular metal members that can be connected to each other by screws, connectors or by interference fit. The bed of a typical trampoline is flat, but in the present invention, pulldown springs change the bed shape and also provide a tension profile along the trampoline bed that can change the bounce of the user so as to urge the user toward the middle portion of the trampoline for example. The trampoline is made of the tubular metal frame having an upper frame 23 that supports a trampoline bed. The upper frame 23 is connected to a lower frame 22. The upper frame 23 may have upper frame cross supports and the lower frame may have lower frame cross supports 25. The cross supports can be welded to the frame to form a rigid frame construction. The lower frame can directly contact the ground.

The pulldown springs 12 are mounted underneath the trampoline bed. The pulldown springs 12 are mounted to pulldown spring connectors 11. The pulldown springs 12 can be vertically oriented and arranged in an array along a plane such that they form a spring panel 10. The vertically oriented springs preferably have spring gaps 45 between them such that they do not touch each other. The pulldown springs 12 can be formed with a lower frame hook 21 that is a bent terminal portion of the pulldown spring 12 to provide a hook that engages one or more openings such as lower frame hook openings 26 in the lower frame 22. The tension of the pulldown springs 12 can be less than the tension in the trampoline bed spring 19.

The pulldown spring connectors 11 can be formed as loops of metal such as triangular loops, or circular or square rings. The pulldown spring connectors 11 are connected to pulldown connector flaps 15. The pulldown connector flaps 15 can be formed as loops of fabric that are looped around the pulldown spring connectors 11. The pulldown connector flaps 15 are preferably stitched to the pulldown flap 13 at a pulldown connector flap stitching edge 16.

Preferably, the pulldown flap 13 is connected to the trampoline bed reinforcement panel 27 and both can be integrally formed together. The trampoline bed reinforcement panel and pulldown connector flap are key features of the present invention. Optionally, the pulldown connector flap 15 can be directly connected to the trampoline bed reinforcement panel 27 if the pulldown flap 13 is omitted. The bottom edge of the pulldown flap 13 optionally has a retainer wire 24 that can provide stability during user jumping and dynamic movement of the trampoline bed 14. The pulldown flap 13 and the trampoline bed reinforcement panel 27 can be made as a single sheet of trampoline bed fabric material that is rectangular. The trampoline bed reinforcement panel 27 could be folded so that it produces a pulldown flap 13 as a protruding fold from the trampoline bed reinforcement panel 27. The protruding fold preferably aligns with the pulldown fold 29 that a user sees from the top surface of the trampoline bed 14.

The pulldown spring connector 11 preferably has rounded inside edges to provide a smooth surface for receiving the pulldown connector flap 15 that loops around the pulldown spring connector 11. The pulldown spring connector 11 preferably has a horizontal upper portion that engages with the pulldown connector flap 15. The pulldown connector flap 15 can have a pair of planar shaped upper ends that are sewn on both sides of the pulldown flap 13, or to one side of the pulldown flap 13. The pulldown flap 13 can be formed as a single sheet of reinforced trampoline bed fabric that is continuous with the trampoline bed reinforcement panel 27.

The trampoline bed reinforcement panel 27 is preferably stitched to the trampoline bed 14 at a location desired to create a pulldown fold 29. The pulldown fold 29 is generally parallel and oriented in the same direction as the retainer wire 24. The pulldown fold 29 can be contacted by the user. From the perspective of a user, the pulldown fold 29 appears to be a continuous part of the trampoline. The pulldown fold 29 has a folding angle 41. The folding angle 41 is the angle between a horizontally oriented trampoline bed and an angled trampoline bed. The horizontally oriented trampoline bed can be a middle trampoline bed 44 and the angled trampoline bed can be a left trampoline bed 42 or a right trampoline bed 43 for example.

The middle trampoline bed 44 can be placed between a left trampoline bed 42 and a right trampoline bed 43. More than one pulldown fold 29 can be formed. A pulldown fold can be formed between the left trampoline bed 42 and the middle trampoline bed 44. Alternatively, a second pulldown fold can be formed between the middle trampoline bed 44 and the right trampoline bed 43. The middle trampoline bed, the left trampoline bed and the right trampoline bed appear to be a single continuous trampoline bed having a continuous trampoline fabric that is terminated at two ends. The trampoline bed is held in tension between a trampoline bed spring 19 that connects to the upper frame 23. The trampoline bed spring 19 is engaged to the upper frame 23 at an upper frame opening hook 47 formed on the trampoline bed spring 19. The trampoline bed spring 19 can be bent at the tip of the spring to provide a hook that forms the upper frame opening hook 47. The trampoline bed spring 19 and the pulldown springs 12 can be made as a wide variety of different kinds of springs such as a coil spring, a torsion spring, rods, helical spring, plate springs and coil springs. The pulldown springs 12 can be made as coil springs and have multiple spring coil windings 46.

The trampoline bed 14 is held between the pair of upper frames 23 by trampoline bed springs 19. The trampoline bed springs 19 are connected to the trampoline bed spring connectors 18. The trampoline bed spring connectors 18 can be formed as metal loops and made in a similar construction as the pulldown spring connectors 11. The trampoline bed spring connectors 18 are preferably connected to the trampoline bed at a bed connector flap 17. The bed connector flap 17 is preferably sewn to a periphery of the trampoline bed 14. The periphery of the trampoline bed 14 is preferably folded and stitched at a hem. The construction of the bed connector flap 17 can be made similarly as the construction of the pulldown connector flap 15. Both can be made as fabric loops that engage a spring connector at one end and a trampoline bed at a second end.

As described in United States patent publication US20130310223 to Canales, the long full-length coil tension spring can be replaced by a shorter length of coil tension spring that is connected to a cord or rope.

Figure 3:
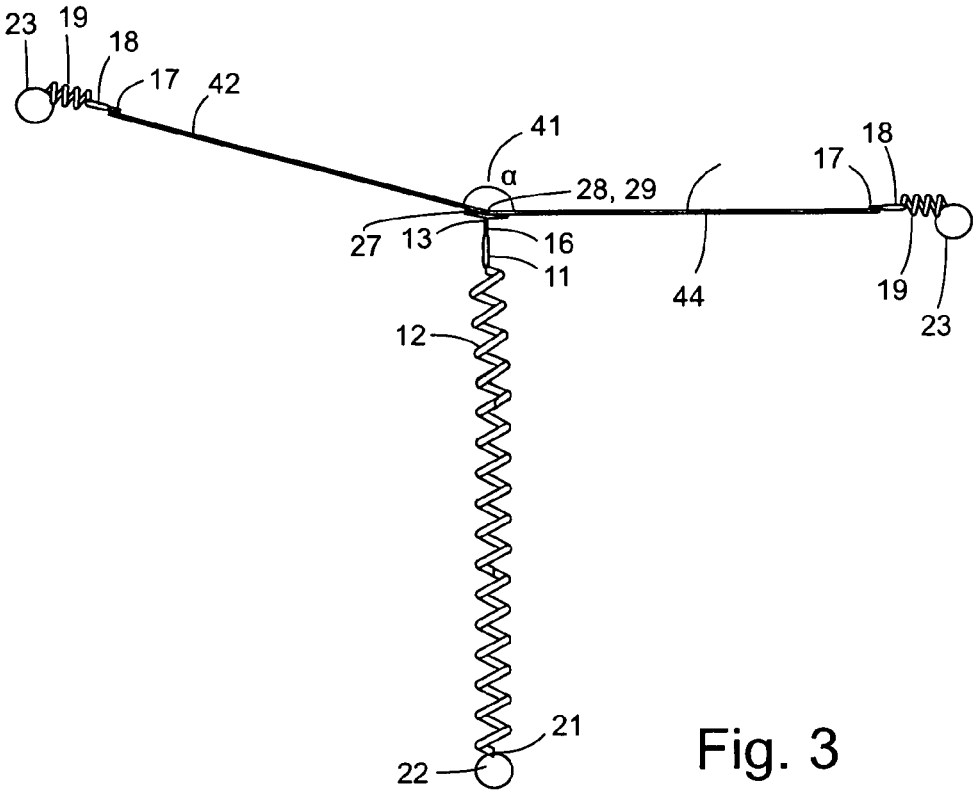
FIG. 3 is a side view of the present invention.
Figure 4:
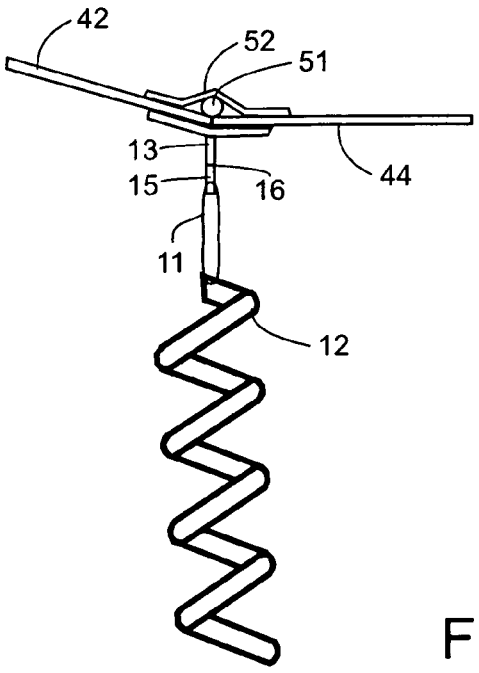
FIG. 4 is a side view of the present invention.

Here, the crosswire 51 is laid over the pulldown fold 29 to define the pulldown fold 29. A crosswire panel 52 can be stitched over the crosswire 51. The crosswire panel 52 can be stitched to the pulldown flap 13 and the trampoline bed reinforcement panel midsection 28. The crosswire panel 52 can be stitched to form a pocket channel that receives the crosswire 51. The fold angle 41 of the pulldown fold 29 can be measured in degree or radians as variable alpha as seen in FIG. 3. The crosswire 51 is preferably formed as a 5 mm diameter round cross-section rod of steel that is extended across the trampoline bed and is connected to the trampoline frame by trampoline springs. The crosswire 51 can be looped at each end for connection to the trampoline springs. The crosswire 51 can be a cable that is resiliently flexible.

The invention claimed is:

1. A trampoline comprising:

a. an upper frame having a first upper frame member and a second upper frame member;

b. a trampoline bed held in tension between and extended between the first upper frame member and the second upper frame member, wherein the first upper frame member is a different height than the second upper frame member;

c. trampoline bed springs connecting between the upper frame and the trampoline bed;

d. a pulldown spring mounted between the trampoline bed and a lower frame, wherein the pulldown spring is held in tension at a trampoline bed reinforcement panel, wherein the pulldown spring biases the trampoline bed reinforcement panel toward the lower frame; and e. a folding angle formed on the trampoline bed, wherein the folding angle separates the trampoline bed between a first trampoline bed area and a second trampoline bed area, wherein the folding angle is obtuse and is measured as the angle between the first trampoline bed area and the second trampoline bed area;

f. a pulldown spring connector connecting the pulldown spring to a pulldown flap, wherein the pulldown spring connector is formed as a loop having a narrow end and a wide end, wherein the narrow end is connected to the pulldown spring and wherein the wide end is connected to the pulldown flap.

2. The trampoline of claim 1, wherein the pulldown flap further comprises:

a. a pulldown connector flap forming a loop around the wide end of the pulldown spring connector, wherein the pulldown connector flap extends from a main portion of the pulldown flap; and b. a pulldown connector flap stitching edge that stitches the pulldown connector flap to the main portion of the pulldown flap.

3. The trampoline of claim 1, further comprising: a lower frame hook formed on a lower portion of the pulldown spring, wherein the pulldown spring is configured as a coil spring, wherein the lower frame hook engages a lower frame hook opening formed on the lower frame, wherein the lower frame is a tubular steel member.

4. The trampoline of claim 1, wherein the trampoline bed reinforcement panel is formed as a strip of fabric that connects to the first trampoline bed area and the second trampoline bed area.

5. The trampoline of claim 1, wherein the trampoline bed reinforcement panel is connected to the pulldown flap.

6. The trampoline of claim 1, further comprising a pulldown flap that has pulldown connector flaps extending from a lower edge of the pulldown flap.

7. The trampoline of claim 1, wherein the first trampoline bed area is an inclined trampoline bed area, and wherein the second trampoline bed area is a generally horizontal trampoline bed area.

8. The trampoline of claim 7, further comprising:

a. a pulldown spring connector connecting the pulldown spring to the pulldown flap, wherein the pulldown spring connector is formed as a loop having a narrow end and a wide end, wherein the narrow end is connected to the pulldown spring and wherein the wide end is connected to the pulldown flap.

9. The trampoline of claim 8, wherein the pulldown flap further comprises:

a. a pulldown connector flap forming a loop around the wide end of the pulldown spring connector, wherein the pulldown connector flap extends from a main portion of the pulldown flap; and b. a pulldown connector flap stitching edge that stitches the pulldown connector flap to the main portion of the pulldown flap.

10. The trampoline of claim 7, further comprising: a lower frame hook formed on a lower portion of the pulldown spring, wherein the pulldown spring is configured as a coil spring, wherein the lower frame hook engages a lower frame hook opening formed on the lower frame, wherein the lower frame is a tubular steel member.

11. The trampoline of claim 7, wherein the trampoline bed reinforcement panel is formed as a strip of fabric that connects to the first trampoline bed area and the second trampoline bed area.

12. The trampoline of claim 7, wherein the trampoline bed reinforcement panel is connected to the pulldown flap.

13. The trampoline of claim 7, The trampoline of claim 1, further comprising a pulldown flap that has pulldown connector flaps extending from a lower edge of the pulldown flap.

14. The trampoline of claim 1, wherein the pulldown springs are substantially vertically oriented and arranged in an array along a plane such that they form a spring panel, wherein the vertically oriented springs have spring gaps between them.

15. The trampoline of claim 1, wherein the trampoline bed reinforcement panel and the pulldown flap are made as a single sheet of trampoline bed fabric material that is generally rectangular.

16. The trampoline of claim 1, further comprising:

a. a pulldown spring connector connecting the pulldown spring to the pulldown flap, wherein the pulldown spring connector is formed as a loop having a narrow end and a wide end, wherein the narrow end is connected to the pulldown spring and wherein the wide end is connected to the pulldown flap;

b. a pulldown connector flap forming a loop around the wide end of the pulldown spring connector, wherein the pulldown connector flap extends from a main portion of the pulldown flap; and c. a pulldown connector flap stitching edge that stitches the pulldown connector flap to the main portion of the pulldown flap, wherein the trampoline bed reinforcement panel and the pulldown flap are made as a single sheet of trampoline bed fabric material that is generally rectangular.

17. The trampoline of claim 16, further comprising: a lower frame hook formed on a lower portion of the pulldown spring, wherein the pulldown spring is configured as a coil spring, wherein the lower frame hook engages a lower frame hook opening formed on the lower frame, wherein the lower frame is a tubular steel member, wherein the trampoline bed reinforcement panel is formed as a strip of fabric that connects to the first trampoline bed area and the second trampoline bed area, wherein the trampoline bed reinforcement panel is connected to the pulldown flap, wherein the pulldown flap has pulldown connector flaps extending from a lower edge of the pulldown flap.

* * * * *